US006360985B1

(12) United States Patent
Phelps et al.

(10) Patent No.: US 6,360,985 B1
(45) Date of Patent: Mar. 26, 2002

(54) DISPENSER ADAPTER FOR CORELESS ROLLS OF PRODUCTS

(75) Inventors: Stephen Lawrence Phelps, Lilburn, GA (US); Arthur J. Garcia, Morrisville, PA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/298,416

(22) Filed: Apr. 23, 1999

Related U.S. Application Data

(60) Provisional application No. 60/087,275, filed on May 29, 1998.

(51) Int. Cl.[7] ..... B65H 18/04; B65H 49/18; B65H 75/24

(52) U.S. Cl. ..... 242/596.4; 242/596.7; 242/571.4

(58) Field of Search ..... 242/596, 596.1, 242/596.2, 596.4, 596.7, 596.8, 571.4

(56) References Cited

U.S. PATENT DOCUMENTS

| | | | |
|---|---|---|---|
| 390,084 | A | 9/1888 | Lane |
| 419,811 | A | 1/1890 | Zerr |
| 498,900 | A | 6/1893 | Hicks |
| 1,217,211 | A | 2/1917 | Pico |
| 1,229,431 | A | 6/1917 | Farrell |
| 1,778,282 | A | 10/1930 | Stewart |
| 2,049,964 | A | 8/1936 | Lawson |
| 2,232,968 | A | 2/1941 | Price et al. |
| 2,276,414 | A | 3/1942 | Morehouse et al. |

(List continued on next page.)

FOREIGN PATENT DOCUMENTS

| | | |
|---|---|---|
| CA | 833971 | 2/1970 |
| CA | 928671 | 6/1973 |
| CA | 2190806 | 6/1997 |
| DE | 1194670 | 6/1965 |
| EP | 0089933 A1 | 9/1983 |
| EP | 0618159 A2 | 2/1994 |
| EP | 0589481 A1 | 3/1994 |
| EP | 0608046 A1 | 7/1994 |
| EP | 0698367 A1 | 2/1996 |

(List continued on next page.)

OTHER PUBLICATIONS

JP 8196469 A (Abstract Only); Assignee: Sekisui Chem Ind Co. Ltd.; Mar. 4, 1991.

JP 8333041 A (Abstract Only); Assignee: Taisei Tekkosho KK; Dec. 17, 1996.

JP 8333055 A (Abstract Only); Assignee: Uchinami KK; Dec. 17, 1906.

(List continued on next page.)

*Primary Examiner*—William A. Rivera
(74) *Attorney, Agent, or Firm*—Dority & Manning, P.A.

(57) ABSTRACT

An adapter for converting a core roll product dispenser into a dispenser for a coreless roll product having a pair of depressions defined in the ends of the coreless roll. The adapter includes: (1) a mounting structure defining a central opening, the mounting structure having a thickness so the central opening has a depth, the mounting structure attachable to a core roll product dispenser; (2) a plunger having a distal end, a central shaft, and a base; and (3) a resilient device connecting the plunger and the mounting structure so that the base of the plunger is located in the central opening and the central shaft and distal end of the plunger protrude from the central opening, the resilient device being configured so that the plunger is adapted to retract into the depth of the central opening when a force is applied against the distal end of the plunger and extend from the central opening when the force is removed. Also disclosed is a dispenser for a coreless roll product having a pair of depressions defined in the ends of the coreless roll.

20 Claims, 6 Drawing Sheets

U.S. PATENT DOCUMENTS

| | | | | |
|---|---|---|---|---|
| 2,299,626 | A | 10/1942 | Hunt | |
| 2,308,840 | A | 1/1943 | Vaughan et al. | |
| 2,380,644 | A | 7/1945 | Grondona | |
| 2,390,399 | A | 12/1945 | Tator et al. | |
| 2,555,885 | A | 6/1951 | Hope | |
| 2,566,883 | A | 9/1951 | Gove | |
| 2,583,411 | A | 1/1952 | Carlin | |
| 2,643,069 | A | 6/1953 | Carlin | |
| 2,695,208 | A | 11/1954 | Graham | 312/39 |
| 2,726,823 | A | 12/1955 | Jespersen | |
| 2,790,608 | A | 4/1957 | Sieven | |
| 2,819,852 | A | 1/1958 | Sarro | |
| 2,830,775 | A | 4/1958 | Kiesel | |
| 2,839,346 | A | 6/1958 | Lawalin | 312/39 |
| 2,845,231 | A | 7/1958 | Grettve | |
| 2,849,191 | A | 8/1958 | Gadler | |
| 2,872,263 | A | 2/1959 | Andersson | 312/39 |
| 2,873,158 | A | 2/1959 | Pinkham | 312/39 |
| 2,879,012 | A | 3/1959 | Sarro | |
| 2,905,404 | A | 9/1959 | Simmons | |
| 2,939,645 | A | 6/1960 | Rowlands et al. | |
| 2,946,636 | A | 7/1960 | Penney | 312/39 |
| 3,004,693 | A | 10/1961 | Johnson | 225/77 |
| 3,029,035 | A | 4/1962 | Layton | |
| 3,032,283 | A | 5/1962 | Wooster | |
| 3,034,739 | A | 5/1962 | Barger | |
| 3,038,598 | A | 6/1962 | Layton et al. | 206/58 |
| 3,045,939 | A | 7/1962 | Vander Waal | |
| 3,084,006 | A | 4/1963 | Roemer | 312/39 |
| RE25,828 | E | 8/1965 | Wooster | |
| 3,333,909 | A | 8/1967 | Beker | 312/39 |
| 3,580,651 | A | 5/1971 | Gauper | 312/39 |
| 3,729,145 | A | 4/1973 | Koo et al. | |
| 3,791,601 | A | 2/1974 | Broden | |
| 3,799,467 | A | 3/1974 | Bauman | |
| 3,802,639 | A | 4/1974 | Dowd, Jr. | |
| 3,823,887 | A | 7/1974 | Gerstein | |
| 3,826,361 | A | 7/1974 | Heckrodt | 206/409 |
| 3,830,143 | A | 8/1974 | Dowd, Jr. | 23/84 FF |
| 3,853,279 | A | 12/1974 | Gerstein | |
| 3,856,226 | A | 12/1974 | Dowd, Jr. | |
| 3,878,998 | A | 4/1975 | Lazzari | |
| D238,462 | S | 1/1976 | Bauman | D6/97 |
| D238,466 | S | 1/1976 | Bauman | D6/97 |
| 4,013,236 | A | 3/1977 | Perrin | |
| 4,013,240 | A | 3/1977 | Perrin | |
| 4,032,077 | A | 6/1977 | Baselice | |
| 4,113,195 | A | 9/1978 | Theunissen | |
| 4,191,307 | A | 3/1980 | LeCaire, Jr. et al. | 221/45 |
| 4,274,573 | A | 6/1981 | Finkelstein | 225/106 |
| 4,289,262 | A | 9/1981 | Finkelstein | 225/106 |
| 4,297,403 | A | 10/1981 | Smith | 428/42 |
| 4,314,679 | A | 2/1982 | Paul et al. | |
| 4,383,656 | A | 5/1983 | Campbell | |
| 4,410,221 | A | 10/1983 | Vallis et al. | 312/39 |
| 4,467,974 | A | 8/1984 | Crim | |
| 4,487,378 | A | 12/1984 | Kobayashi | |
| 4,513,923 | A | 4/1985 | Ulics | |
| 4,535,947 | A | 8/1985 | Hidle | |
| 4,583,642 | A | 4/1986 | Blythe et al. | 206/390 |
| 4,614,312 | A | 9/1986 | Del Pino | |
| 4,634,067 | A | 1/1987 | White | |
| 4,659,028 | A | 4/1987 | Wren | |
| 4,662,576 | A | 5/1987 | Paul | |
| 4,667,890 | A | 5/1987 | Gietman, Jr. | |
| 4,695,005 | A | 9/1987 | Gietman, Jr. | |
| 4,757,952 | A | 7/1988 | Balzer | |
| 4,760,970 | A | 8/1988 | Larsson et al. | |
| 4,767,075 | A | 8/1988 | Peters et al. | |
| 4,783,015 | A | 11/1988 | Shimizu | |
| 4,807,825 | A | 2/1989 | Elsner et al. | |
| 4,832,271 | A | 5/1989 | Geleziunas | |
| 4,860,893 | A | 8/1989 | Kaufman | 200/390 |
| D316,201 | S | 4/1991 | Shimasaki | D6/518 |
| D318,770 | S | 8/1991 | Grisel | D6/523 |
| 5,065,924 | A | 11/1991 | Granger | 225/46 |
| 5,097,998 | A | 3/1992 | Shimasaki | 225/106 |
| 5,100,075 | A | 3/1992 | Morand | |
| D327,798 | S | 7/1992 | Addison et al. | D6/523 |
| 5,161,793 | A | 11/1992 | Lotto et al. | 271/182 |
| 5,170,938 | A | 12/1992 | Dewing | 239/52 |
| 5,170,958 | A | 12/1992 | Brown | |
| 5,197,727 | A | 3/1993 | Lotto et al. | 271/183 |
| 5,205,455 | A | 4/1993 | Moody | 225/106 |
| 5,215,211 | A | 6/1993 | Eberle | 221/1 |
| 5,219,126 | A | 6/1993 | Schutz | |
| 5,253,818 | A | 10/1993 | Craddock | |
| 5,271,137 | A | 12/1993 | Schutz | 29/400.1 |
| 5,271,575 | A | 12/1993 | Weinert | |
| 5,277,375 | A | 1/1994 | Dearwester | |
| 5,281,386 | A | 1/1994 | Weinert | 265/512 |
| 5,310,129 | A | 5/1994 | Whittington et al. | |
| 5,314,131 | A | 5/1994 | McCanless et al. | |
| 5,352,319 | A | 10/1994 | Ishizu et al. | 156/446 |
| 5,362,013 | A | 11/1994 | Gietman, Jr. et al. | 242/521 |
| 5,366,175 | A | 11/1994 | Schutz | 242/597.6 |
| 5,370,336 | A | 12/1994 | Whittington | 242/560.2 |
| 5,370,339 | A | 12/1994 | Moody et al. | 242/597.6 |
| 5,372,865 | A | 12/1994 | Arakawa et al. | 428/40 |
| 5,385,318 | A | 1/1995 | Rizzuto | 242/597.8 |
| 5,386,950 | A | 2/1995 | Abt | 242/532 |
| 5,387,284 | A | 2/1995 | Moody | 118/220 |
| 5,390,875 | A | 2/1995 | Gietman, Jr. et al. | 242/521 |
| 5,402,960 | A | 4/1995 | Oliver et al. | 242/527.1 |
| 5,407,509 | A | 4/1995 | Ishizu et al. | 156/184 |
| 5,421,536 | A | 6/1995 | Hertel et al. | 242/526.1 |
| 5,439,187 | A | 8/1995 | Shimizu | 242/541.7 |
| 5,451,013 | A | 9/1995 | Schutz | 242/597.4 |
| 5,453,070 | A | 9/1995 | Moody | 493/288 |
| 5,467,935 | A | 11/1995 | Moody | 242/422.4 |
| 5,467,936 | A | 11/1995 | Moody | 242/525.7 |
| 5,474,436 | A | 12/1995 | Yamazaki | 425/103 |
| 5,480,060 | A | 1/1996 | Blythe | 221/63 |
| 5,495,997 | A | 3/1996 | Moody | 242/561 |
| 5,497,959 | A | 3/1996 | Johnson et al. | 242/542.2 |
| 5,505,402 | A | 4/1996 | Vigneau | 242/527.1 |
| 5,513,478 | A | 5/1996 | Abt | 53/118 |
| 5,518,200 | A | 5/1996 | Kaji et al. | 252/538.1 |
| 5,538,199 | A | 7/1996 | Biagiotti | 242/541.2 |
| 5,542,622 | A | 8/1996 | Biagiotti | 242/521 |
| 5,577,686 | A | 11/1996 | Moody | 242/597.4 |
| 5,603,467 | A | 2/1997 | Perini et al. | 242/521 |
| 5,609,269 | A | 3/1997 | Behnke et al. | 221/48 |
| 5,611,455 | A | 3/1997 | McCreary | 221/45 |
| 5,618,008 | A | 4/1997 | Dearwester et al. | 242/594.5 |
| 5,620,148 | A | 4/1997 | Mitchell | 242/160.4 |
| 5,620,544 | A | 4/1997 | Cram et al. | 156/184 |
| 5,636,812 | A | 6/1997 | Conner et al. | 242/559.2 |
| 5,639,046 | A | 6/1997 | Biagiotti | 242/541.2 |
| 5,642,810 | A | 7/1997 | Warner et al. | 206/389 |
| 5,660,349 | A | 8/1997 | Miller et al. | 242/526.1 |
| 5,669,576 | A | 9/1997 | Moody | 242/560.3 |
| 5,690,296 | A | 11/1997 | Biagiotti | 242/521 |
| 5,697,576 | A | 12/1997 | Bloch et al. | 242/596.8 |
| 5,722,608 | A | 3/1998 | Yamazaki | 242/160.1 |
| 5,725,176 | A | 3/1998 | Vigneau | 242/521 |
| 5,730,387 | A | 3/1998 | Yamazaki | 242/532.3 |
| 5,746,379 | A | 5/1998 | Shimizu | 242/160.1 |
| 5,794,882 | A | 8/1998 | Lewis | 242/423.1 |
| 5,797,559 | A | 8/1998 | Coffey | 242/527.6 |
| 5,839,680 | A | 11/1998 | Biagiotti | 242/160.1 |

| | | | | |
|---|---|---|---|---|
| 5,848,762 | A | 12/1998 | Reinheimer et al. | 242/595 |
| 5,849,357 | A | 12/1998 | Andersson | 427/179 |
| 5,868,275 | A | 2/1999 | Moody | 221/33 |
| 5,868,342 | A | 2/1999 | Moody et al. | 242/560 |
| 5,875,985 | A | 3/1999 | Cohen et al. | 242/160 |
| 5,895,008 | A | 4/1999 | Sanders | 242/541.2 |
| 5,904,316 | A | 5/1999 | Dunning et al. | 242/595 |

FOREIGN PATENT DOCUMENTS

| | | | |
|---|---|---|---|
| EP | 0729724 | A1 | 9/1996 |
| EP | 0842881 | A2 | 5/1998 |
| FR | 2251202 | | 6/1975 |
| GB | 1 248 002 | | 9/1971 |
| GB | 2 120 206 | A | 11/1983 |
| GB | 2 244 472 | A | 12/1992 |
| GB | 2 276 107 | A | 9/1994 |
| GB | 2 294 681 | A | 5/1996 |
| WO | 93/10700 | | 6/1993 |
| WO | 93/21094 | | 10/1993 |
| WO | 94/27483 | | 12/1994 |
| WO | 94/29205 | | 12/1994 |
| WO | 95/01929 | | 1/1995 |
| WO | 95/08940 | | 4/1995 |
| WO | 95/13183 | | 5/1995 |
| WO | 96/26878 | | 9/1996 |
| WO | 96/27546 | | 9/1996 |
| WO | 96/28079 | | 9/1996 |
| WO | 99/12462 | | 3/1999 |

OTHER PUBLICATIONS

JP 9118455 A (Abstract Only); Assignee: Taisei Tekkosho KK; May 6, 1997.

JP 9216755 A (Abstrsct Only); Assignee: Yamazaki T; Aug. 19, 1997.

JP 9323849 A (Abstract Only); Assignee: Taisei Tekkosho KK; Dec. 16, 1997.

TW 293002 A (Abstract Only); Assignee: Minnesota Mining & Mfg. Co.; Dec. 11, 1996.

Counterpart PCT International Search Report, mailed Sep. 15, 1999.

DISPENSER ADAPTER FOR CORELESS ROLLS OF PRODUCTS

This Appln claims benefit of Prov. No. 60/087,275 filed May 29, 1998.

FIELD OF THE INVENTION

This invention pertains to the field of commercial and consumer roll form products, absorbent paper products, which includes toilet tissue and paper towels more specifically, this invention relates to an adapter for a dispenser of coreless rolls.

BACKGROUND OF THE INVENTION

Commercial and consumer absorbent products such as shop towels, nonwoven fabrics, wipers, toilet tissue and paper towels are often distributed and dispensed in roll format. Most products in this format include a cylindrical core at the center of the roll. Typically, the product is wrapped about the core. Most roll format product dispensers require this core to function properly. The core is usually some type of cardboard tube, plastic tube, or solid spindle which is glued to the product so that the product does not separate from the core.

Product is normally loaded by mounting the roll on a spindle in a manner similar to the ubiquitous bathroom toilet roll dispenser. The spindle passes through or otherwise penetrates the inner space of the core. Some dispensers include pegs that penetrate the hollow space within the core for only a limited extent, as demonstrated in U.S. Pat. Nos. 390,084 and 2,905,404 to Lane and Simmons, respectively.

Recently, coreless rolls of products such as, for example, toilet tissue have appeared on the market, primarily in Europe. These coreless rolls are wound throughout the entire diameter of the roll. There are advantages and disadvantages associated with the coreless rolls. Coreless rolls are ecologically superior to cored rolls because they lack the central core made of plastic, cardboard or other material. In addition, more product can be provided in the space that would otherwise have been occupied by the core.

Cored rolls are more expensive to manufacture than coreless rolls because of the expense of making the cores and joining the cores to the product. In addition, coreless rolls have the advantage of being less subject to pilferage in commercial locations because of their inherent incompatibility with conventional dispensers.

On the other hand, coreless roll products have dispensing problems that are difficult to overcome. Coreless rolls do not fit into conventional core roll dispensers. Moreover, even though coreless rolls are less likely to be pilfered because they are incompatible with conventional dispensing systems, the lack of a core and spindle passing through the product that can be locked makes it relatively difficult to keep the coreless format product secure.

Conventional dispensers for coreless rolls typically include an enclosed surface that supports the roll as it turns, and an opening through which the product is passed. While functional, these dispensers have some undesirable characteristics, including an inability to control drag resistance to withdrawal of the product; the fact that the product actually touches the inside of the dispenser, which might be considered unsanitary by some consumers; and an inability to provide 180 degree product access to the consumer. Some dispensers for coreless rolls have pressure plates and pins that project into the side of the roll between the layers of product. It can be difficult to center the roll during loading of these dispenser without a centering device and the pressure plate and pins can easily be pried back to release the roll from the dispenser.

Accordingly, it is clear that a need exists for an adapter to convert conventional cored roll dispensers to handle coreless rolls. A need also exists for a coreless roll dispenser that can secure a coreless roll against pilferage. There is also a need for an adapter to convert conventional core roll dispensers to dispense coreless rolls of absorbent consumer and commercial paper products. There is a further need or a dispenser that can dispense coreless rolls of absorbent consumer and commercial paper products so they can be secured against pilferage.

SUMMARY OF THE INVENTION

The problems described above are addressed by the present invention which encompasses an adapter for converting a core roll product dispenser into a dispenser for a coreless roll product having a pair of depressions defined in the ends of the coreless roll.

The adapter includes: (1) a mounting structure defining a central opening, the mounting structure having a thickness so the central opening has a depth; (2) a plunger having a distal end, a central shaft, and a base; (3) resilient means connecting the plunger and the mounting structure so that the base of the plunger is located in the central opening and the central shaft and distal end of the plunger protrude from the central opening, the resilient means being configured so the plunger is adapted to retract into the depth of the central opening when a force is applied against the distal end of the plunger and extend from the central opening when the force is removed; and (4) attachment means for securing the adapter to a core roll product dispenser.

According to the invention, the mounting structure may further includes or incorporate a mounting base so the adapter may be more easily attached to a core roll product dispenser.

The resilient means connecting the plunger with the mounting base may be one or more flexible cantilever arms. It is contemplated that a spring, clip, sponge, elastomeric material or the like may also be used.

The base of the plunger may be configured to define an opening to a cavity at the interior of the plunger. The resilient means may protrude into the cavity at the interior of the plunger. For example, if the resilient means is a spring or clip, the spring or clip may protrude into the base of the plunger.

The mounting structure should have a thickness so the central opening has a depth. Desirably, the thickness should be sufficient to permit the plunger to retract into the depth of the central opening. It is contemplated that the mounting structure may have a minimal thickness if the mounting base and/or the dispenser to which the adapter is attached has a cavity or other space into which the plunger may retract when a force is applied to displace the plunger during loading.

In an embodiment of the invention, the central opening defined by the mounting structure may be substantially circular. The opening may be triangular, square, diamond, semi-circular, "X", "Y" or "T" -shaped or the like. Desirably, the central opening defined by the mounting structure will match the cross-section of the plunger. Accordingly, the plunger may have cross-section that is substantially circular, triangular, square, diamond, semi-circular, "X", "Y" or "T" -shaped or the like.

It is desirable that the plunger has a cross-section width of at least 1 centimeter. If the plunger has a substantially circular cross-section, it is desirable that the diameter be at least 1 centimeter. The distal end of the plunger may have a radius of curvature and desirably defines a hemisphere. Of course, other geometries are contemplated for the shape of the distal end of the plunger. It is also contemplated that the plunger may have a narrow width or a variable width.

The distal end of the plunger may extend from the central opening defined by the mounting structure for a distance that is greater than the width of the plunger. For example, if the plunger has a cross-section width of about 1 centimeter, it is desirable for the distal end of the plunger to extend more than about 1 centimeter from the central opening defined by the mounting structure. As a further example, the distal end of the plunger may extend for 1.25 centimeters, 1. 5 centimeters, 1.75 centimeters, 2.0 centimeters, or 2.25 centimeters or more. A greater extension of the plunger helps provides greater penetration into the depressions defined at the ends of the coreless roll product and helps to prevent pilferage of the coreless roll product from the dispenser.

The present invention also encompasses a dispenser for a coreless roll product having a pair of depressions defined in the ends of the coreless roll. The dispenser includes: a frame; mounting means for permitting the frame to be mounted to a stationary surface such as a wall; and a coreless roll securing means for securing a coreless roll product for rotation within the frame. The coreless roll securing means contains at least one element including: (1) a mounting structure defining a central opening, the mounting structure having a thickness so the central opening has a depth; (2) a plunger having a distal end, a central shaft, and a base; (3) resilient means connecting the plunger and the mounting structure so that the base of the plunger is located in the central opening and the central shaft and distal end of the plunger protrude from the central opening, the resilient means being configured so the plunger is adapted to retract into the depth of the central opening when a force is applied against the distal end of the plunger and extend from the central opening when the force is removed; and (4) attachment means for securing the adapter to a core roll product dispenser.

The mounting means for the dispenser may be, for example, an opening defined in the frame for a securing member such as a bolt. Other mounting means, such as clips, pins, screws, latches and the like may also be used.

In an embodiment of the present invention, the coreless roll securing means may further include a pair of opposed arms that are connected to the frame. In such an embodiment, there is mounted to an inner side of each arm an element including: (1) a mounting structure defining a central opening, the mounting structure having a thickness so the central opening has a depth; (2) a plunger having a distal end, a central shaft, and a base; (3) resilient means connecting the plunger and the mounting structure so that the base of the plunger is located in the central opening and the central shaft and distal end of the plunger protrude from the central opening, the resilient means being configured so the plunger is adapted to retract into the depth of the central opening when a force is applied against the distal end of the plunger and extend from the central opening when the force is removed; and (4) attachment means for securing the adapter to a core roll product dispenser, whereby radial displacement of the coreless roll with respect to said frame is prevented during use.

The dispenser may further include biasing means for resiliently biasing at least one of the opposed arms toward the coreless roll. The biasing means may be in the form of at least one of the opposed arms being constructed out of a resilient material, so that arm (or arms) is configured so as to be slightly displaced when a coreless roll is secured within the dispenser.

The coreless roll securing means of the dispenser is composed of at least one of the elements described above. These elements include resilient means connecting the mounting frame with the plunger. The resilient means may desirably be at least one cantilever arm. It is contemplated that the resilient means may be a spring, clip, sponge, elastomeric material or the like.

The base of the plunger may be configured to define an opening to a cavity at the interior of the plunger. The resilient means may protrude into the cavity at the interior of the plunger. For example, if the resilient means is a spring or clip, the spring or clip may protrude into the base of the plunger.

The central opening defined by the mounting structure may be substantially circular. The opening may be triangular, square, diamond, semi-circular, "X", "Y" or "T"-shaped or the like. Desirably, the opening at the end of the central cavity will match the cross-section of the plunger. Accordingly, the plunger may have cross-section that is substantially circular, triangular, square, diamond, semi-circular, "X", "Y" or "T" -shaped or the like.

It is desirable that the plunger has a cross-section width of at least 1 centimeter. If the plunger has a substantially circular cross-section, it is desirable that the diameter be at least 1 centimeter. The distal end of the plunger may have a radius of curvature and desirably defines a hemisphere. Of course, other geometries are contemplated for the shape of the distal end of the plunger. It is also contemplated that the plunger may have a narrow width or a variable width.

The distal end of the plunger may extend from the central opening defined by the mounting structure for a distance that is greater than the width of the plunger. For example, if the plunger has a cross-section width of about 1 centimeter, it is desirable for the distal end of the plunger to extend more than about 1 centimeter from the central opening defined by the mounting structure. As a further example, the distal end of the plunger may extend for 1.25 centimeters, 1. 5 centimeters, 1.75 centimeters, 2.0 centimeters, or 2.25 centimeters or more. A greater extension of the plunger helps provides greater penetration into the depressions defined at the ends of the coreless roll product and helps to prevent pilferage of the coreless roll product from the dispenser.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION

Figure 1:
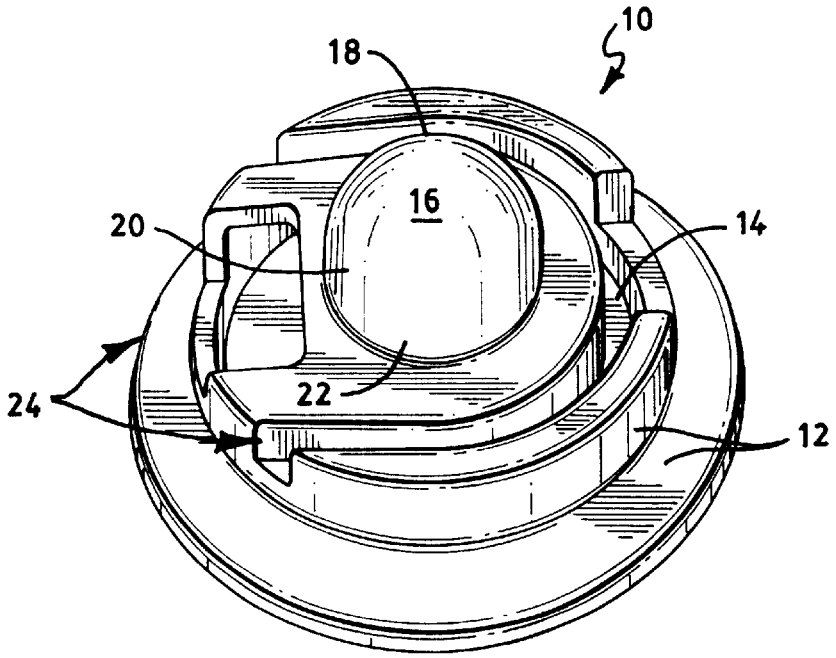
FIG. 1 is an illustration of an exemplary adapter for converting a core roll product dispenser to a coreless roll product dispenser.

Referring now to the drawings, wherein like reference numerals designate corresponding structure throughout the views, and referring in particular to FIG. 1, there is shown (not necessarily to scale) an illustration of an exemplary adapter 10 for converting a core roll product dispenser into a dispenser for a coreless roll product having a pair of depressions defined in the ends of the coreless roll.

The adapter includes a mounting structure 12 defining a central opening 14. The mounting structure has a thickness so the central opening had a depth. The adapter contains a plunger 16 having a distal end 18, a central shaft 20, and a base 22. The adapter also includes a resilient means 24 that connects the mounting structure with the plunger 16. An attachment means (not shown) may also be included on the adapter for securing the adapter to a core roll product dispenser.

Figure 2:
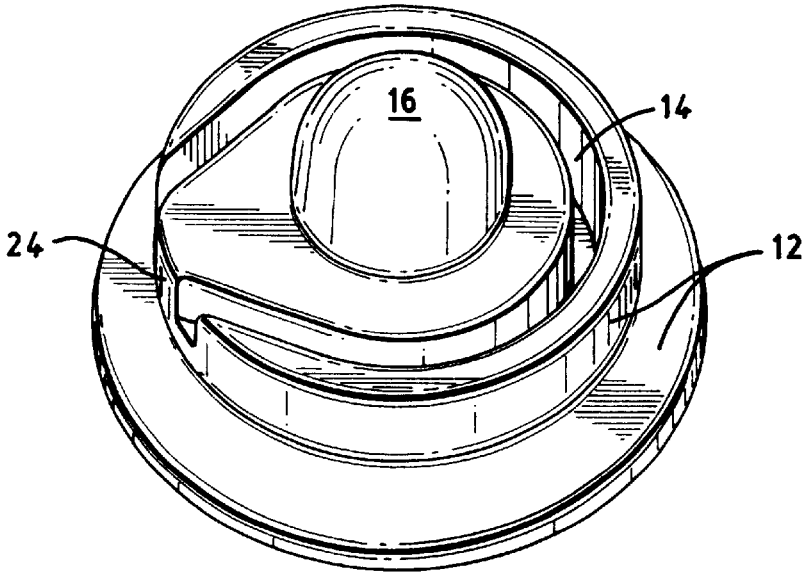
FIG. 2 is an illustration of an exemplary adapter for converting a core roll product dispenser to a coreless roll product dispenser.

Referring now to FIG. 2, there is shown another embodiment of the invention. In this embodiment, the resilient means 24 that connects the mounting structure with the plunger is a single cantilever arm instead of two cantilever arms as depicted in FIG. 1.

Figure 3:
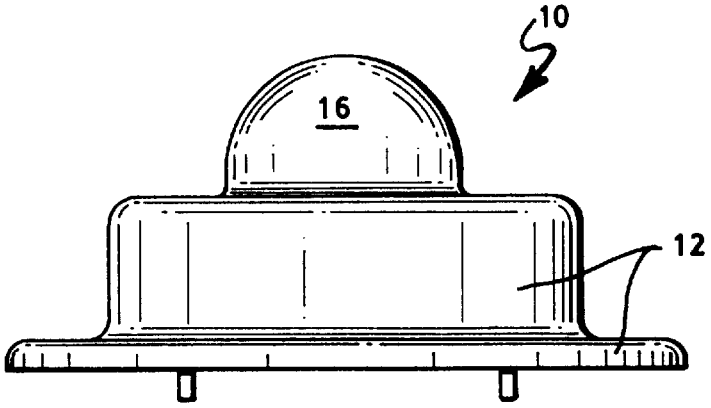
FIG. 3 is an illustration of a feature of an exemplary adapter.
Figure 4:
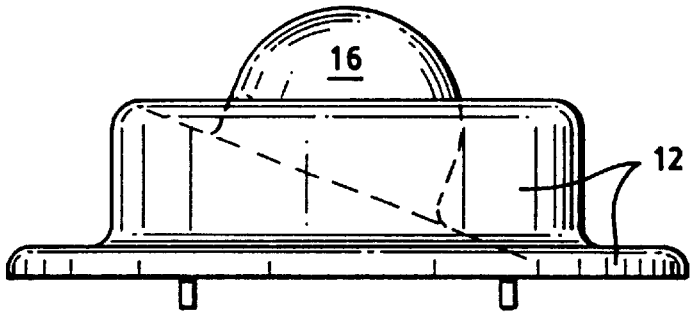
FIG. 4 is an illustration of a feature of an exemplary adapter.
Figure 5:
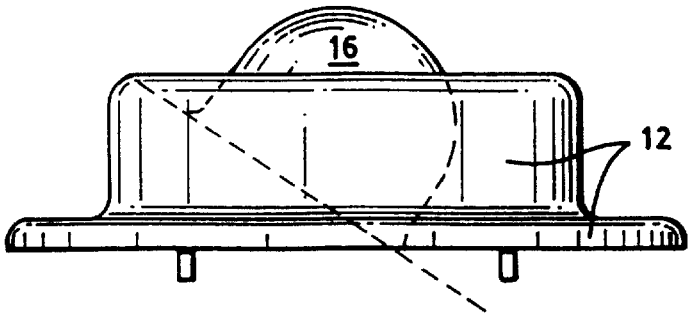
FIG. 5 is an illustration of a feature of an exemplary adapter.

FIGS. 3, 4 and 5 are illustrations of a cross-sectional view of an exemplary adapter showing an exemplary mode of operation. FIG. 3 shows the adapter 10 including the mounting structure 12 and the plunger 16. FIG. 4 shows the plunger 16 as it is displaced from its normal configuration. This would occur during loading of a dispenser with a coreless roll of product. The broken lines depict the portion of the plunger displaced into the depth of the central opening defined by the mounting structure. In this embodiment, the plunger 16 pivots into the depth of the central opening at the point where the resilient means connects the plunger to the mounting structure. Generally speaking, when the resilient means is one or more flexible cantilever arms, the plunger will pivot at the point of connection with the mounting structure. FIG. 5 illustrates the adapter when the plunger is displaced beyond the depth of the central opening defined by the mounting structure. It is contemplated that the thickness of the mounting structure may be increased so depth of the central opening is sufficient to accommodate the substantially all of the plunger. Alternatively, the adapter may be used in connection with a dispenser that has a cavity or void that can accommodate a portion of the plunger to the extent it may be displaced beyond the mounting frame.

The plunger may be configured so it is essentially fixed or unable to rotate about an axis. In such case, it is desirable that the plunger be constructed of materials providing low levels of friction to allow the coreless roll to rotate freely. Alternatively, the plunger may be configured so it may rotate freely. It is contemplated that the plunger may be configured so it is able to rotate with the coreless roll during dispensing.

The resilient means 24 is configured so the plunger 16 is adapted to retract (e.g., pivot or move) into the depth of the central opening 14 defined by the mounting structure 12 when a force is applied against the distal end of the plunger during loading and extend from the central opening 14 when the force is removed. The resilient means connecting the plunger with the mounting structure is desirably at least one cantilever arm formed of plastic or similar material that is used to form the plunger and mounting structure. Alternatively and/or additionally, the resilient means may be a spring, clip, sponge, elastomeric material or the like. The force provided or applied by the resilient means serves two purposes.

First, the resilient means allows the plungers to retract or pivot during the loading process. In some dispenser configurations the distance between the two adapters is fixed so it is just slightly larger than the width of the roll. The plungers must be able to retract in order to load the roll.

Second, the force provided or applied by the resilient means is used to retain the roll when the diameter of the roll is very small. The force must be balanced so it retains a nearly depleted roll but does not apply too much pressure to prevent the roll from rotating on the fixed plunger.

The base of the plunger may be configured to define an opening to a cavity at the interior of the plunger. That is, the plunger may be essentially hollow. The resilient means may protrude into the cavity at the interior of the plunger. For example, if the resilient means is a spring or clip, the spring or clip may protrude into the base of the plunger.

The mounting structure of the adapter may further include or incorporate a mounting base so the adapter may be more easily attached to a core roll product dispenser. The mounting base may be configured to provide a large footprint that provides more stability and/or surface area. A large surface area may be advantageous if adhesives are used (alone or in combination with other attachment means such as, for example, clips, pins, screws, bolts or the like) to join the adapter to a core roll product dispenser. The mounting structure 12 and/or the mounting base may be configured to fit various size or depth recesses to replace the conventional roll-supporting spindle. For example, some conventional core roll product dispensers have recesses that are greater than about 0.25 inch (approximately 0.6 cm) in depth while other dispensers have recesses that are less than 0.25 inch in depth. According to the invention, the mounting structure and/or mounting base may be configured to fit the recess without modifying the core roll product dispenser while remaining easily removable if needed.

Figure 6:
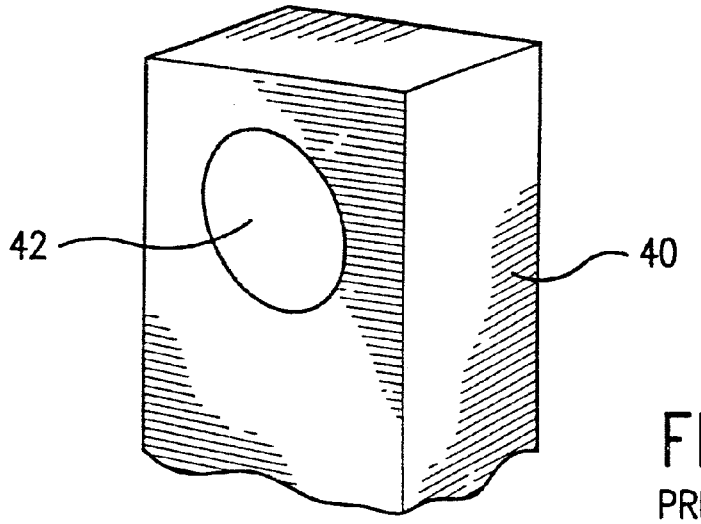
FIG.6 PRIOR ART
FIG. 6 is an illustration of a dispensing arm from a conventional core roll product dispenser.

FIG. 6 is an illustration of a portion of an arm typically found on conventional core roll format product dispensers. The illustration shows a dispensing arm 40 defining an opening 42. This opening 42 is normally configured to receive a spindle (not shown) that passes through the center of a core roll product as in a conventional bathroom tissue dispenser. Alternatively and/or additionally, the opening 42 may be adapted to receive a spindle on which the core roll product was wound or otherwise provided with. Conventional core roll product dispensers typically have two of these dispensing arms (with openings 42) mounted in a frame. Some conventional dispensers may have sides instead of arms and may have openings configured in the sides. In either case, the arms or sides and corresponding openings are separated by a distance that is slightly greater than the width of the roll of the core roll product to be dispensed.

Figure 7:
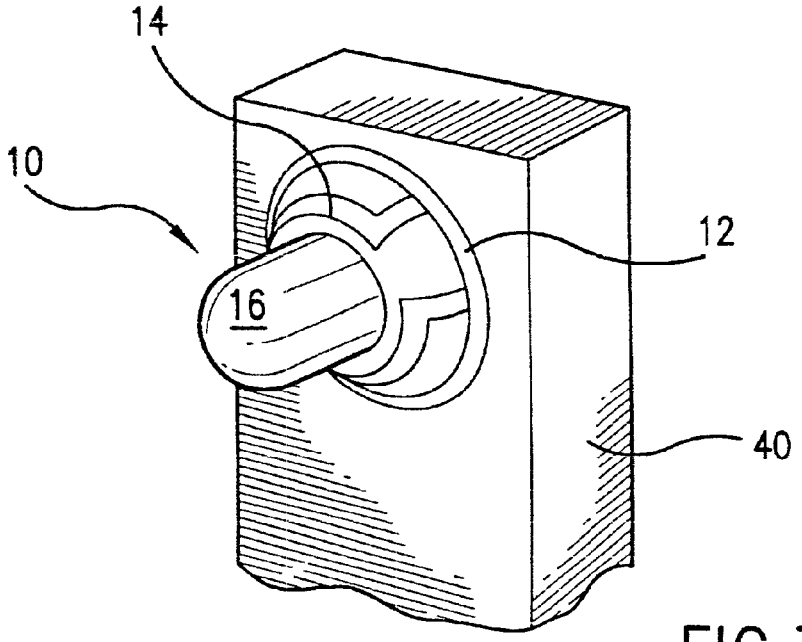
FIG. 7 is an illustration of an exemplary adapter fitted in a dispensing arm of a conventional core roll product dispenser.

FIG. 7 is an illustration of an exemplary adapter mounted on the conventional core roll product dispensing arm 40 shown in FIG. 6. The adapter 10 fits into the opening 42 shown in FIG. 6. In this illustration, a portion of the mounting structure 12 is shown extending from the arm 40. A plunger 16 is shown protruding from a central opening 14 in the mounting structure. Mounting such adapters 10 on each arm of a conventional core roll product dispenser quickly and easily converts a conventional dispenser to a coreless roll product dispenser. The plungers 16 protruding from each arm and which are capable of retracting or pivoting into the central opening defined by the mounting structure are adapted to fit into depressions defined at each end of the coreless roll product.

In an embodiment of the invention, the central 14 opening defined by the mounting structure 12 may be substantially circular. The central opening 14 may also be any suitable shape or cross-section. For example, the central opening 14 may be triangular, square, diamond, semi-circular, "X", "Y" or "T" -shaped or the like. Desirably, the opening at the end of the central cavity will match the cross-section of the plunger. Accordingly, the plunger may have a cross-section that is substantially circular, triangular, square, diamond, semi-circular, "X", "Y" or "T" -shaped or the like.

Generally speaking, it is desirable for the plunger to have a cross-section width that is slightly greater than the width of the depression in the end of the coreless roll product. This configuration helps secure the roll when loaded, prevents overspin of the roll during dispensing, and assists in holding the roll as the roll is depleted. For example, if the depressions defined in both ends of the coreless roll have a diameter of slightly less than 1 centimeter (e.g., ~0.9 cm) the plunger desirably will have a diameter or width of about 1 centimeter or slightly greater than 1 centimeter.

In an embodiment of the invention, it is desirable that the plunger has a cross-section width of at least 1 centimeter (approximately ½ inch). If the plunger has a substantially circular cross-section, it is desirable that the diameter be at least 1 centimeter. The distal end of the plunger may have a radius of curvature and desirably defines a hemisphere. The rounded tip serves as a centering device for loading the roll and eases loading by providing a leading edge. The straight sides of the plunger help keep the roll from wobbling during dispensing, help the roll rotate freely and avoid damage to the roll during dispensing. Of course, other geometries are contemplated for the shape of the distal end of the plunger. It is also contemplated that the plunger may have a narrow width or a variable width.

Desirably, the distal end of the plunger extends from the opening at the end of the housing for a distance that is greater than the width of the plunger. For example, if the plunger has a cross-section width of about 1 centimeter, it is desirable for the distal end of the plunger to extend more than about 1 centimeter from the opening at the end of the housing. As a further example, the distal end of the plunger may extend for 1.25 centimeters, 1.5 centimeters, 1.75 centimeters, 2.0 centimeters, or 2.25 centimeters or more. A greater extension of the plunger helps provides greater penetration into the depressions defined at the ends of the coreless roll product. Good penetration of the plunger into the coreless roll and the straight, smooth sides of the plunger help to prevent pilferage of the coreless roll product from the dispenser by making it difficult to get a grip on the plunger to push it back into a retracted position and unload the roll. Thus the product may be loaded on the dispenser until the roll is substantially depleted.

Figure 8:
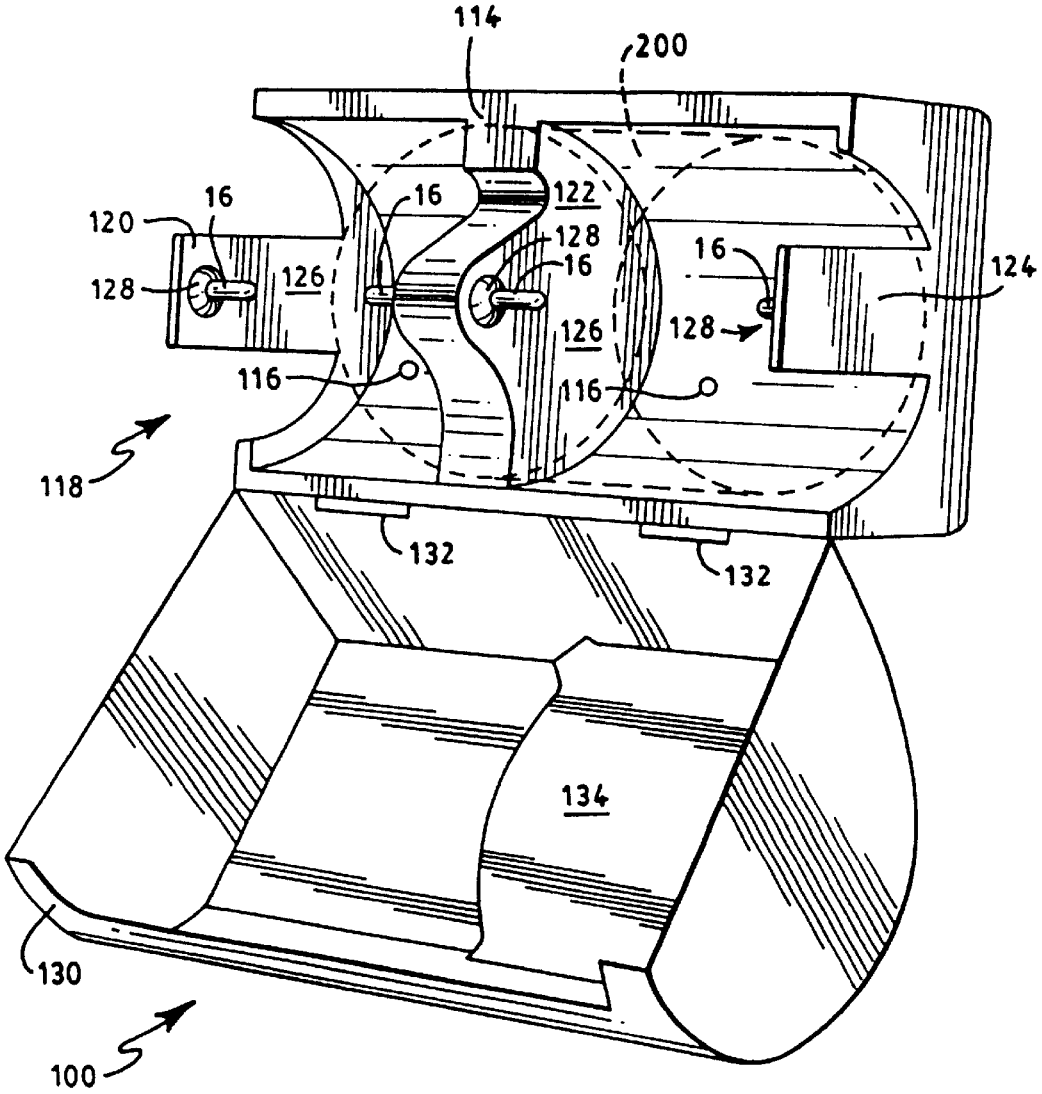
FIG. 8 is an illustration of an exemplary coreless roll product dispenser.
Figure 9:
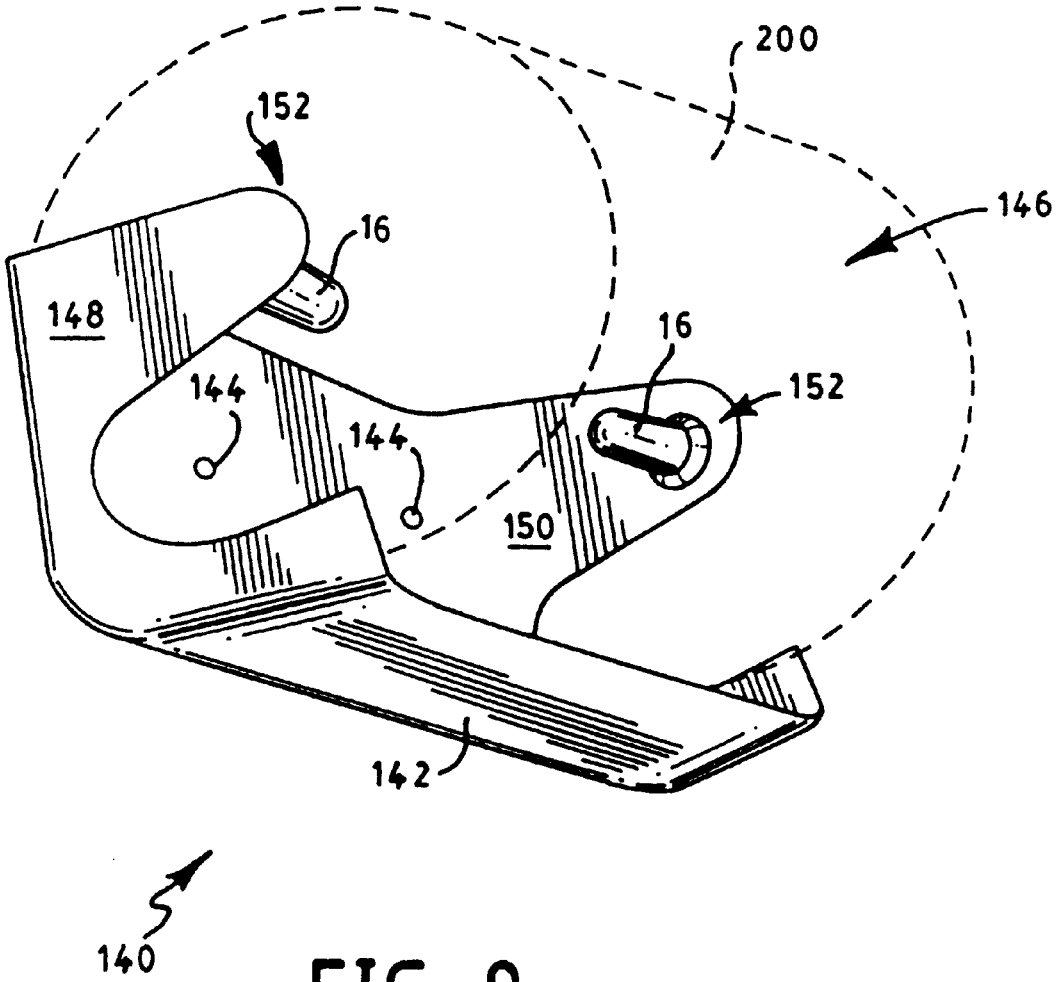
FIG. 9 is an illustration of an exemplary coreless roll product dispenser.
Figure 10:
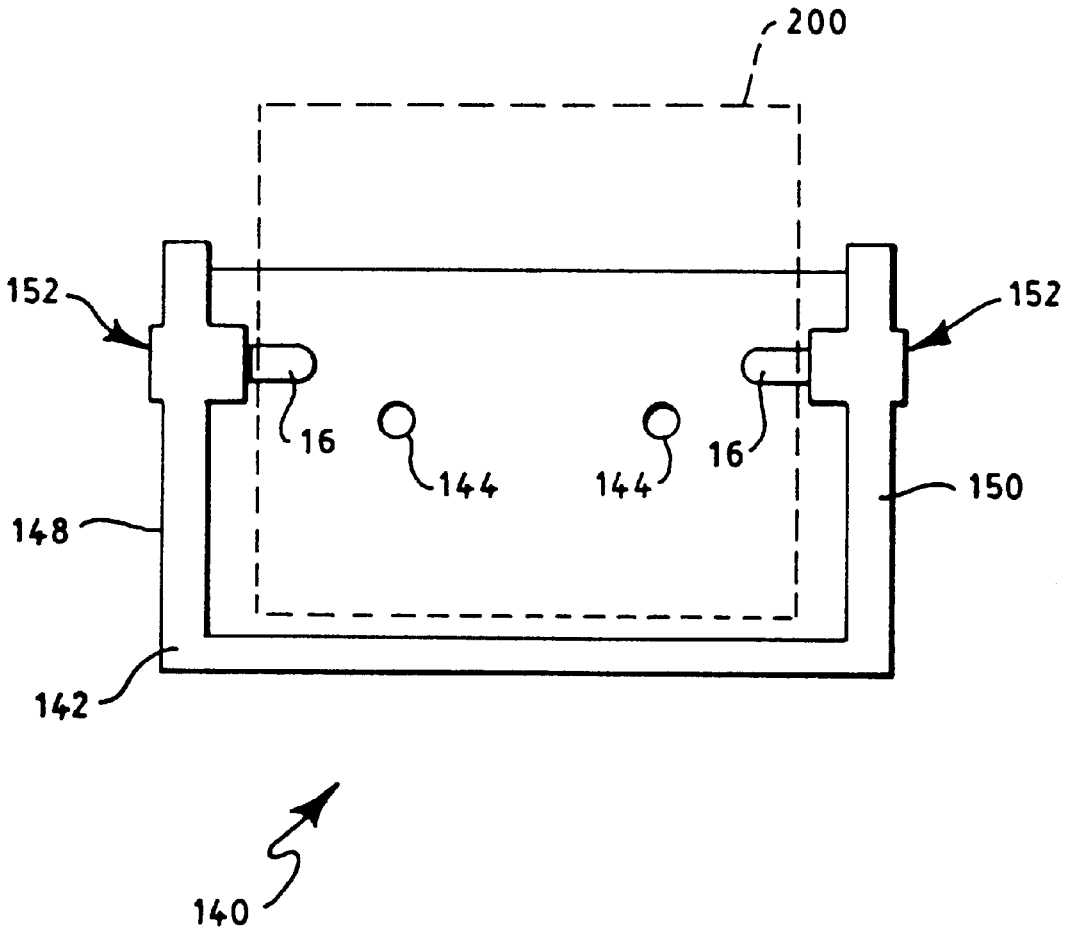
FIG. 10 is an illustration of an exemplary coreless roll product dispenser.

The present invention also encompasses a dispenser for dispensing a coreless roll product having a pair of depressions defined in the ends of the coreless roll. Many different types of products may be produced in a coreless roll format. For example, commercial and consumer absorbent products such as shop towels, nonwoven fabrics, wipers, bathroom tissue and paper towels are often distributed and dispensed in roll format. Referring now to FIGS. 8–10 and in particular to FIG. 8, there is shown a dispenser 100 for dispensing coreless roll products 200 (shown in broken lines) having a pair of depressions defined in the ends of the coreless roll.

The dispenser 100 includes a frame 114 that has mounting holes 116 defined therein for permitting the frame to be mounted to a stationary surface, such as a wall. The dispenser 100 further includes a coreless roll securing mechanism 118 for securing a coreless roll 200 of product (e.g., bathroom tissue) for rotation within the frame 114. In the embodiment shown in FIGS. 8, the coreless roll securing mechanism 118 includes a first arm 120, a second, central arm 122 and a third arm 124.

The dispenser 100 depicted in FIG. 8 is designed to accommodate two rolls of coreless roll product (e.g., bathroom tissue), much in the manner of many conventional dispensers that are available for commercial application. Desirably, the outer arms 120, 124 are constructed so they are rigid and will not move. However, in an embodiment of the invention, the outer arms 120, 124 may be made of a resilient material, such as spring steel or plastic, and are configured so they will be slightly displaced when a coreless roll is secured between the central arm 122 and the respective outer arms 120, 124. In this way, the outer arms 120, 124 will bias the respective coreless roll 200 toward the central arm 122.

One important advantage of the invention is that the coreless roll securing mechanism 118 is designed to prevent radial displacement of the coreless rolls 200 with respect to the frame 114 of the dispenser 100 during use, so that a coreless roll can be dispensed without fear of radial displacement during use as confidently as a conventional cored roll of absorbent paper product can be dispensed.

Desirably, this is achieved by providing elements 128 on inner surfaces 126 of the respective arms 120, 122, 124 of the securing mechanism 118. Each element 128 is configured essentially in accordance with the adapter construction shown in FIGS. 1–5. As an example and with reference to FIG. 1, each element may include a mounting structure 12 defining a central opening 14. The mounting structure 12 may be an integral part of the respective arms 120, 122, and 124 (shown in FIG. 8) or may be a discrete unit that is attached to each of the arms. Each element includes a plunger 16 having a distal end 18, a central shaft 20, and a base 22. Each element may also include a resilient means 24 that connects the mounting structure with the plunger 16.

The elements 128 of the securing mechanism 118 may optionally include an attachment means. The attachment means may be used if the housing is constructed as a discrete unit and is not integral with the arms of the securing mechanism (i.e., if the housing is not molded, welded, constructed, formed, etc. as part of the arms of the securing mechanism). Other features of the elements 128 of the securing mechanism 118 are essentially in accordance with the adapter construction as shown in FIGS. 1 and 2 and described above.

For example, the elements 128 may be constructed so the plunger is adapted to penetrate a depression defined at an end of a coreless roll product. The plunger may be configured so it is essentially fixed or unable to rotate about an axis. In such case, it is desirable that the plunger be constructed of materials providing low levels of friction to allow the coreless roll to rotate freely. Alternatively, the plunger may be configured so it may rotate freely. It is contemplated that the plunger may be configured so it is able to rotate with the coreless roll during dispensing.

The resilient means is configured to provide or apply a force against the plunger so the plunger is adapted to retract or pivot into the depth of the central opening when a greater opposing force is applied against its distal end during loading and extend when the greater opposing force is removed. The resilient means connecting the plunger with the mounting frame is desirably one or more flexible cantilever arms. It is contemplated that the resilient means may be a spring, clip, sponge, elastomeric material or the like.

In an embodiment, the base of the plunger may be configured to define an opening to a cavity at the interior of the plunger. The resilient means may protrude into the cavity at the interior of the plunger. For example, if the resilient means is a spring or clip, the spring or clip may protrude into the base of the plunger.

Referring to FIG. 8, a number of plungers 16 extend inwardly from the respective elements 128 toward where the coreless roll 200 of product will be held during operation. These plungers 16, which are adapted to retract or pivot during loading of the dispenser, are specifically designed to penetrate the depressions defined at each end of the coreless roll to secure the coreless roll against pilferage and to prevent radial displacement of the careless roll during use.

In embodiments of the invention where the arms 120 and 124 are constructed out of resilient material, it will be appreciated that the biasing provided by the resiliency of arms will aid the plungers 16 in penetrating depressions defined at the ends of the coreless roll and enhance the securement of the coreless rolls within the dispenser 100 during use.

Desirably, the dispenser 100 includes a cover 130 that is hinged to the frame 114 by hinges 132. A sliding window 134 may be provided in the cover 130 to selectively expose the roll 200 of coreless roll product that is being dispensed at a particular point in time, and to deny access to the other roll or vacated mounting location. The cover 130, hinges 132, and the sliding window 134 are conventional.

Referring now to FIGS. 9 and 10, there is shown another embodiment of the present invention. FIGS. 9 and 10 illustrate an exemplary dispenser 140 for dispensing a coreless roll 200 of product. FIG. 9 is a perspective view of an exemplary dispenser. FIG. 10 is a front view of an exemplary dispenser. The dispenser 140 includes a frame 142, which is embodied as a relatively simplified shield about the space where the coreless roll 200 will be positioned during use. The frame 142 has mounting holes 144 defined in a rear portion thereof for mounting the dispenser 140 to a stationary surface, such as a wall. The dispenser 140 further includes a coreless roll securing mechanism 146 that is embodied as a first arm 148 and a second arm 150. A pair of elements 152 mounted to the respective arms 148, 150 and have plungers 16 thereon that are constructed and arranged to penetrate into the depressions defined at the ends of the coreless roll in the manner described above. It is contemplated that the elements 152 may be molded, formed, cast, welded or otherwise constructed as an integral part of the arms 148 and 152 instead of being discrete units mounted on the arms.

It is contemplated that only one of the elements needs to be configured so that its plunger is retractable or pivotable to achieve satisfactory operation of the present invention (e.g., to load of the dispenser). Desirably, both or all elements will be configured so the plungers will be retractable.

The present invention also encompasses a method of installing a coreless roll having a pair of depressions defined at opposite ends of the roll in a dispenser. The method includes the steps of: (a) applying a force to at least one retractable plunger to retract the plunger (i.e., applying a force to a plunger that is adapted to retract into the depth of the central opening when a force is applied against the distal end of the plunger and extend from the central opening when the force is removed); and (b) orienting a coreless roll with a pair of depressions at opposite ends of the roll so at least one depression is adjacent at least one plunger; (c) securing the coreless roll to the dispenser by penetrating at least one depression in the coreless roll with at least one plunger. The method of the present invention encompasses embodiments where step (b) involves orienting the coreless roll so both depressions are adjacent plungers. The method of the present invention further encompasses embodiments where step (c) involves penetrating both depressions with plungers.

The method of the present invention may further involve resiliently biasing the plungers into the coreless roll during operation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An adapter for converting a core roll product dispenser into a dispenser for a coreless roll product having a pair of depressions defined in the ends of the coreless roll, the adapter comprising:

a mounting structure defining a central opening, the mounting structure having a thickness so the central opening has a depth, the mounting structure having a base attachable directly onto an outer surface of an arm of a core roll dispenser;

a plunger having a distal end, a central shaft, and a base; and resilient means connecting and retaining the plunger in operable position relative to the mounting structure so that the base of the plunger is located in the central opening and the central shaft and distal end of the plunger protrude from the central opening, the resilient means attaching and holding the plunger to the mounting structure so the plunger is adapted to retract into the depth of the central opening when a force is applied against the distal end of the plunger and extend from the central opening when the force is removed.

2. The adapter of claim 1, wherein the base of the plunger defines an opening to a cavity at the interior of the plunger.

3. The adapter of claim 1, wherein the resilient means in communication with the plunger is a cantilever arm.

4. The adapter of claim 1, wherein the central opening in the mounting structure is substantially circular.

5. The adapter of claim 1, wherein the plunger has a substantially circular cross-section.

6. The adapter of claim 1, wherein the plunger has a cross-section diameter of at least 1 centimeter.

7. The adapter of claim 1, wherein the distal end of the plunger defines a hemisphere.

8. The adapter of claim 1, wherein the distal end of the plunger extends from the central opening of the mounting structure for a distance that is greater than the width of the plunger.

9. A dispenser for a coreless roll product having a pair of depressions defined in the ends of the coreless roll, the dispenser comprising:

a frame;

mounting means for permitting the frame to be mounted to a stationary surface such as a wall; and a coreless roll securing means including roll supporting members connected to the frame for securing a coreless roll product for rotation within the frame, the coreless roll securing means comprising at least one element including:

at least one mounting structure defining a central opening, the mounting structure having a thickness so the central opening has a depth, the mounting structure attached directly onto an outer surface of one of the roll supporting members;

a plunger having a distal end, a central shaft, and a base; and resilient means connecting and retaining the plunger in operable position relative to the mounting structure so that the base of the plunger is located in the central opening and the central shaft and distal end of the plunger protrude from the central opening, the resilient means attaching and holding the plunger to the mounting structure so the plunger is adapted to retract into the depth of the central opening when a force is applied against the distal end of the plunger and extend from the central opening when the force is removed.

10. The dispenser of claim 9, wherein said mounting means comprising an opening defined in said frame for receipt of a securing member therethrough.

11. The dispenser of claim 9, wherein the roll supporting members comprise a pair of opposed arms that are connected to the frame, the mounting structure attached to an inside outer surface of each arm whereby radial displacement of the coreless roll with respect to said frame is prevented during use.

12. The dispenser of claim 11, further comprising biasing means for resiliently biasing at least one of opposed arms toward said coreless roll.

13. The dispenser of claim 12, wherein said biasing means comprises at least one of said opposed arms being constructed out of a resilient material, and said at lest one arm is configured so as to be slightly displaced when a coreless roll is secured within the dispenser.

14. The dispenser of claim 9, wherein the base of the plunger defines an opening to a cavity at the interior of the plunger.

15. The dispenser of claim 9, wherein the resilient means in communication with the plunger is at least one cantilever arm.

16. The dispenser of claim 9, wherein the central opening in the mounting structure is substantially circular.

17. The dispenser of claim 9, wherein the plunger has a substantially circular cross-section.

18. The dispenser of claim 9, wherein the plunger has a cross-section diameter of at least 1 centimeter.

19. The dispenser of claim 9, wherein the distal end of the plunger defines a hemisphere.

20. The dispenser of claim 9, wherein the distal end of the plunger extends from the central opening of the mounting structure for a distance that is greater than the width of the plunger.

* * * * *